US006588809B1

(12) United States Patent
Derman

(10) Patent No.: US 6,588,809 B1
(45) Date of Patent: Jul. 8, 2003

(54) PUSH-TO-RELEASE CABINET DOOR LATCH

(76) Inventor: Jay S. Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 10/133,883

(22) Filed: Apr. 29, 2002

(51) Int. Cl.[7] ..... E05C 19/10

(52) U.S. Cl. ..... 292/129; 292/95; 292/179; 292/DIG. 4; 292/DIG. 5

(58) Field of Search ..... 292/129, 95, 127, 292/177, 179, DIG. 37, 117, 120, 124, 132, 136, 98, 197, 203, 102, 215, 224, 234, DIG. 15, DIG. 4; 24/458, 604, 652; 16/82, 83, 85, DIG. 32

(56) References Cited

U.S. PATENT DOCUMENTS

| | | | | | |
|---|---|---|---|---|---|
| 172,212 | A | * | 1/1876 | Vreeland | 292/215 |
| 487,153 | A | * | 11/1892 | Orth | 70/156 |
| 524,594 | A | * | 8/1894 | Iske | 292/197 |
| 570,503 | A | * | 11/1896 | Robertson | 292/67 |
| 756,453 | A | * | 4/1904 | Arens et al. | 292/163 |
| 780,417 | A | * | 1/1905 | Euphrat | 292/19 |
| 901,501 | A | * | 10/1908 | Vest | 292/254 |
| 1,694,023 | A | * | 12/1928 | Suck | 292/99 |
| 1,822,327 | A | * | 9/1931 | Ullom | 292/95 |
| 2,464,543 | A | * | 3/1949 | Modrey | 24/603 |
| 2,479,597 | A | * | 8/1949 | Anton | 16/86 A |
| 2,496,691 | A | * | 2/1950 | Berry | 292/251.5 |
| 2,885,237 | A | * | 5/1959 | Heyer | 292/70 |
| 2,914,792 | A | * | 12/1959 | Campbell | 16/82 |
| 3,086,803 | A | * | 4/1963 | Wilson | 292/17 |
| 3,180,666 | A | * | 4/1965 | Jorgenson | 292/70 |
| 3,243,836 | A | * | 4/1966 | Reiss | 16/85 |
| 3,466,075 | A | * | 9/1969 | Fernandez et al. | 292/19 |
| 3,675,959 | A | * | 7/1972 | Hansen et al. | 292/70 |
| 3,918,752 | A | * | 11/1975 | Leone et al. | 292/174 |
| 4,057,935 | A | * | 11/1977 | Rohrberg et al. | 49/56 |
| 4,063,330 | A | * | 12/1977 | Triplette | 16/142 |
| 4,133,142 | A | * | 1/1979 | Dzus | 49/379 |
| 4,159,837 | A | * | 7/1979 | Morita | 292/127 |
| 4,179,143 | A | * | 12/1979 | Shy | 292/179 |
| 4,302,864 | A | * | 12/1981 | Morita | 16/85 |
| 4,383,707 | A | * | 5/1983 | Nishimura | 292/110 |
| 4,779,906 | A | * | 10/1988 | Kurosaki | 292/19 |
| 5,121,950 | A | * | 6/1992 | Davidian | 292/164 |
| 5,380,053 | A | * | 1/1995 | Saino | 292/144 |
| 5,553,351 | A | * | 9/1996 | Starks | 16/223 |
| 5,581,963 | A | * | 12/1996 | Snair et al. | 52/282.2 |
| 6,321,412 | B1 | * | 11/2001 | Duco | 16/85 |

FOREIGN PATENT DOCUMENTS

| | | | |
|---|---|---|---|
| DE | 473263 | * | 4/1929 |
| FR | 1363849 | * | 5/1964 |

* cited by examiner

*Primary Examiner*—William L. Miller
*Assistant Examiner*—Carlos Lugo
(74) *Attorney, Agent, or Firm*—Monty Koslover

(57) ABSTRACT

A latching device which comprises a cabinet door catch member and a cabinet probe member that is adapted to engage the catch member. The probe member includes a floating shaft that is disposed axially in a housing, and which includes a projection that is shaped and positioned to engage a groove in the catch member when the door is closed. Provision is made for automatic separation and opening of the cabinet door when the catch member is released by the probe member shaft. Release of the catch member is effected by a single smart rap on the outside of the door. The device is simple, reliable and economical to produce.

4 Claims, 2 Drawing Sheets

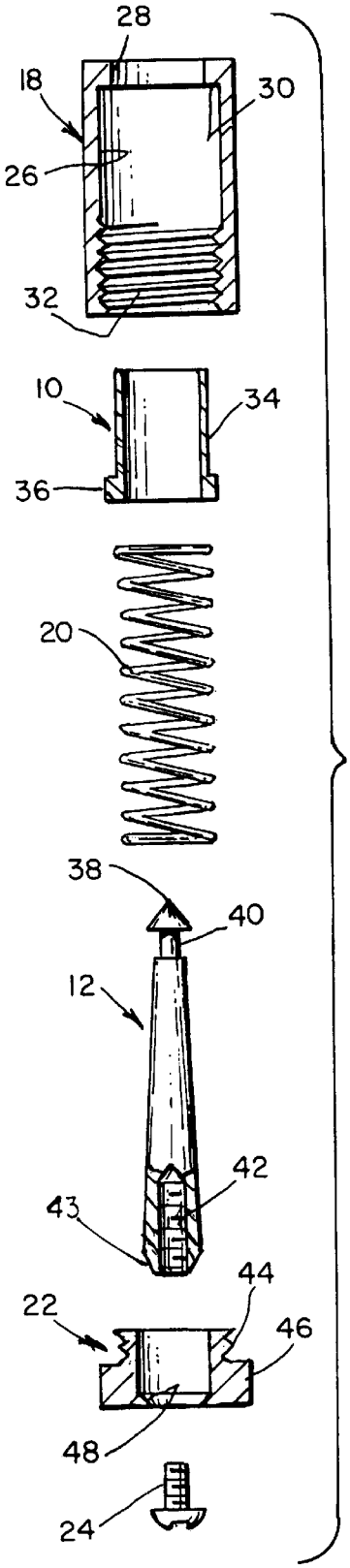
Fig. 5.
Fig. 6.
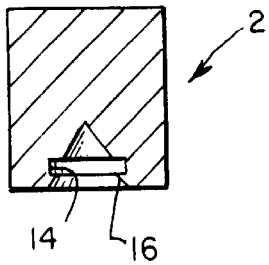
Fig. 8.
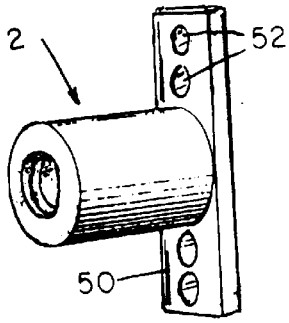
Fig. 7.
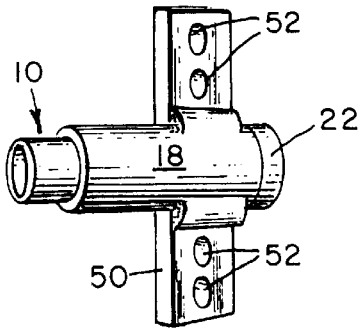
Fig. 4.
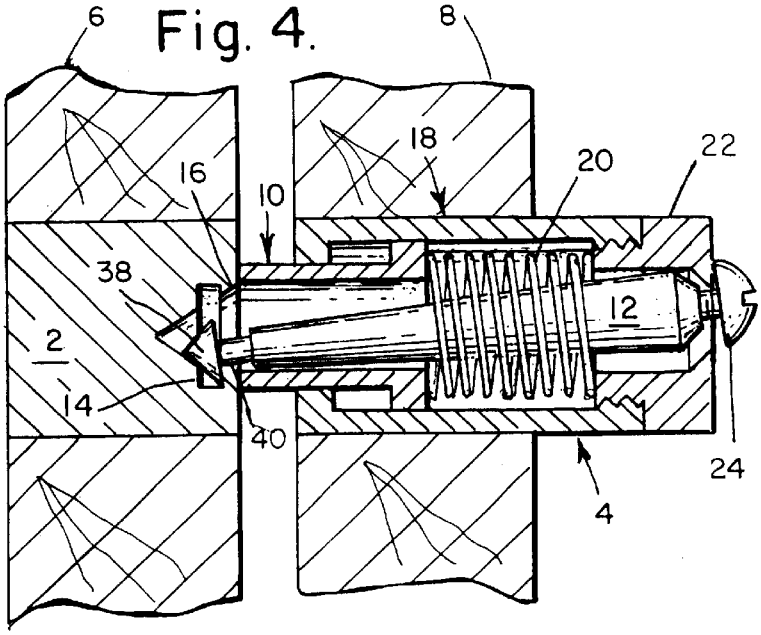

PUSH-TO-RELEASE CABINET DOOR LATCH

BACKGROUND OF THE INVENTION

1. Field of the Invention

This invention relates to latching devices and more particularly, to devices for latching a cabinet door or panel.

2. Background

There presently exist a number of different devices for temporarily holding a cabinet door closed. Some of these devices utilize a magnetic catch for placement on a door which engages a post or plate that is attached to a wall or door frame. Others use forms of mechanical clasping elements as a catch to clasp a member that is attached to an opposing surface. In some devices, a projecting portion of the device has to be manually pulled to release a closed door. This takes appreciable force as do most of the other devices.

However, the most widely used latches for kitchen cabinets today are simple metal clamp and roller devices that are inexpensive, tend to break with usage and have a relatively short useful life.

It would therefore be useful to have available an inexpensive cabinet door latching device that is reliable in operation and has a long useful life. It also would be helpful if the latching device required little applied force to release a closed cabinet door.

SUMMARY OF THE INVENTION

The invention is a latching device with two parts: a catch member and a probe member. The catch member is installed on the inner surface of a cabinet door, with the probe member installed into a portion of the cabinet frame opposing the catch member. The catch member contains provision for snaring a hooked member or equivalent. Opposing the catch member is the probe member, which consists of an elongated housing that contains an axially disposed floating shaft connected to a closed end of the housing. The shaft is adapted to hook on to and engage the catch member when the cabinet door and catch member are pushed against the cabinet frame. The probe member also includes provision for automatically separating the cabinet door from the frame after the catch member is released from the shaft. A single smart push on the cabinet door is all that is required to release the catch member. The door can not be opened by pulling or shaking the door.

Accordingly, it is a prime object of the present invention to provide a latching device for holding cabinet doors closed, that requires little applied force for closure or release.

Another object of this invention is to provide a latching device that is sturdy and has a long useful life.

A further object of this invention is to provide a latching device that is adaptable to various cabinet door closure configurations.

An advantage of the invention over other latching devices is its relatively low cost.

Another advantage of the invention is safety in the prevention of young children from opening latched cabinet doors that are accessible to them.

Further objects and advantages of the invention will be apparent from studying the following portion of the specification, the claims and the attached drawings.

BRIEF DESCRIPTION OF THE DRAWINGS

FIG. 4 is a cross-section elevation view of the present invention latching device installed, with the probe member engaging the catch member and holding a cabinet door closed; particularly exaggerating component features and spacing to ease understanding of the device operation;

FIG. 5 is an exploded view of the probe member, particularly showing some components in cross-section view for clarity;

FIG. 6 is a cross-section view of the invention catch member;

FIG. 7 is a perspective view of a probe member according to the present invention, attached to a mount for fastening to a cabinet; and FIG. 8 is a perspective view of a catch member according to the present invention, attached to a mount for fastening to a cabinet door.

DESCRIPTION OF THE PREFERRED EMBODIMENT

The invention is a push-to-release latching device which may be typically applied to holding a cabinet door closed.

Figure 1:
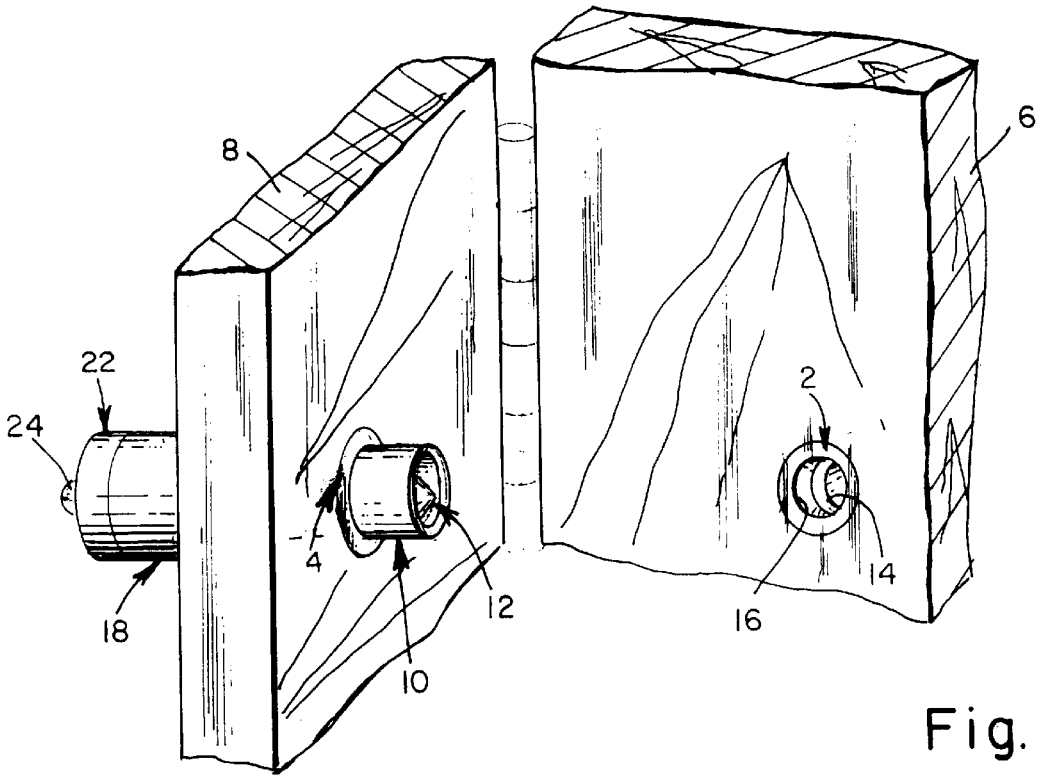
FIG. 1 is a perspective view of a preferred embodiment of the present invention latching device, particularly showing a catch member installed on a cabinet door and ready to engage the end of a probe member that is installed opposite on a surface that simulates part of a cabinet support wall.

Referring to FIG. 1, the invention latching device comprises two parts: a catch member 2 and a probe member 4, which are shown installed on two members 6, 8 that are connected by a hinge. One member represents a portion of a cabinet door 6 on which is installed the catch member 2. The other member represents a portion of a cabinet frame 8 which opposes the catch member, and on which the probe member 4 is installed.

Figure 2:
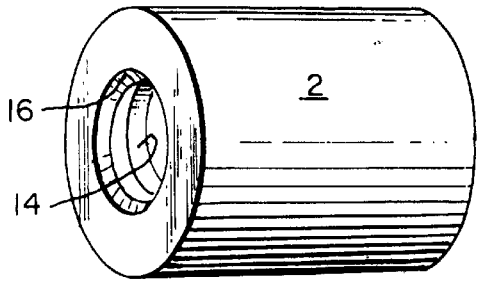
FIG. 2 is a perspective view of a catch member according to the present invention.
Figure 3:
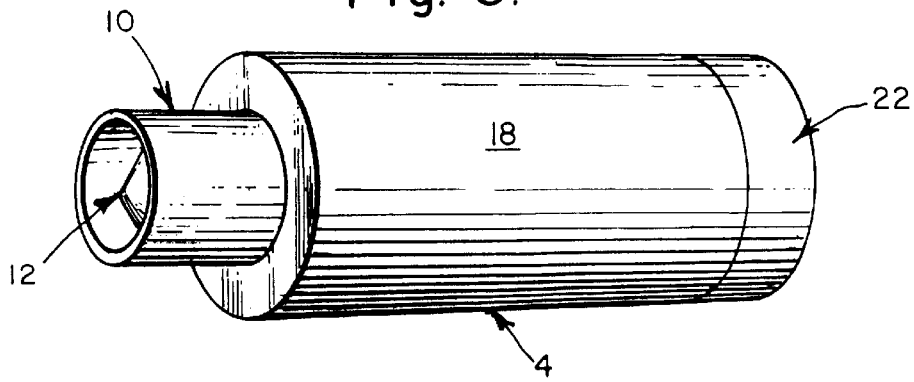
FIG. 3 is a perspective view of a probe member according to the present invention.

A catch member 2 and a probe member 4 are shown respectively, in FIGS. 2 and 3. The catch member 2 is a cylindrical body having an axial, conical shaped orifice 16 in one end and including a deep annular groove 14 cut in the orifice wall. The probe member 4 comprises a housing shell 18, a sleeve 10 which fits inside the shell 18 and protrudes out of an opening in one end of the shell, a tapered floating shaft 12 that is disposed axially inside the shell 18, a cap member 22 that is fastened to the distal end of the shell 18, a helical spring 20 which applies pressure to one end of the sleeve 10, and a fastening screw 24 that loosely attaches the shaft 12 to the cap 22.

Referring again to FIG. 1, when a movable cabinet door 6 with an installed catch member 2, is rotated and pushed steadily against a stationary cabinet frame 8 having an installed probe member 4, the probe member sleeve 10 is pushed a little way inwards, compressing the spring 20. At the same time, the tip end of the floating shaft 12 enters the catch member orifice 16, and the shaft head 38 falls by gravity into a groove 14 inside the orifice 16, catching on an edge of the groove 14. At the same time, the compressed spring 20 exerts pressure on the sleeve 10 which transfers the pressure to the face of the catch member 2 and thereby grips a wall of the groove 14 firmly against the shaft head 38, preventing movement of the cabinet door away from the cabinet frame 8.

The foregoing action latches the cabinet door 6 closed tight against the cabinet frame 8 and the resulting latched state is illustrated in FIG. 4.

If the cabinet door 6 was made to shake violently as in an earthquake, or attempts were made to pull the door open by force, the catch member groove 14 would continue to retain the head 38 of the shaft 12 as shown in FIG. 4, and the cabinet door 6 would not open.

In order to open a latched cabinet door, all that is needed is to give the door a single smart push. This action pushes the shaft head 38 out of the groove 14 and centers the shaft head in the catch member orifice 16, releasing the shaft. The compressed spring 20 immediately expands and pushes the probe member sleeve 10 forward against the catch member 2 face, and thus automatically pushes the cabinet door 6 open and away.

It should be noted that the spring 20 exerts no pressure at any time on the shaft 12, but only on the sleeve 10. Thus, in addition to exerting force against the face of the catch member, the spring 20 and sleeve 10 provide a means for separating the cabinet door automatically from the frame upon release of the shaft 12 from the catch member 2. The benefits of this approach are several. The spring compressive force is relatively low and there is no resistance to shaft penetration of the catch member orifice. Therefore, the force needed to push the cabinet door to latch it closed will also be low.

Similarly, only a single smart, slap against the back of the catch member in a cabinet door is required to release the door, which then springs open.

The counter intuitive approach of this slap or push to-release method, has the added safety benefit of preventing small children from opening a latched cabinet door by pulling on the door handle or on any exposed door release mechanism, such as exists on several available latching devices. In the present invention the door release mechanism is totally hidden when the cabinet door is latched.

Refer now to FIG. 5 which is an exploded view of the probe member 4, and to FIG. 6 which is a cross section view of the catch member 2. Several of the probe member components are shown in cross section view or are partially cut away to expose significant areas.

A cap member 22 is shown to include a threaded portion 44 with which to engage with the threaded portion 32 in one end of the shell 18. A concentric annular shoulder 46 is provided for screwing the cap member 22 on to the shell 18. An axial hole bored through the cap member 22 includes an inwardly beveled end portion 48 to loosely seat the similarly beveled end 43 of the shaft 12.

The shaft 12 includes an axial threaded opening 42 in its beveled end 43, which is engaged by a fastening screw 24 to fasten the shaft 12 loosely to the cap member 22 and allow the shaft 12 to float from one end. The shaft, which is tapered from its beveled end 43 to its distal end, also includes a cone shaped head 38 on its distal end, with a narrow neck.portion 40 immediately behind the head 38. This provides a substantial edge surface for engaging the groove 14 in the catch member orifice 16.

The shell 18 includes an axial bore 26 that extends from one end, which is threaded 32, to near the shell distal end 30. An opening 28 is made in the shell distal end, concentric with the bore axis, to hold a protruding sleeve 10 that is contained axially within the shell bore 26.

The sleeve 10 is tubular in shape 34 and is sized to fit slidingly through the shell end opening 28. A concentric rim flange 36 is provided on one end, both to retain the sleeve in the shell and to form a surface against which a helical metal spring 20 acts when the probe member 4 is assembled.

For some applications, it might be desirable for either the probe member 4 or the catch member 2 to be installed using attached mounts. In response, a typical configuration of a probe member 4 with attached mount 50 is shown in FIG. 7, and a catch member 2 with an attached mount 50 is shown in FIG. 8. The mounts 50 each include a plurality of through holes 52 for attaching the devices with screws to a cabinet door or frame.

The device parts are fabricated from a rigid, hard material and may be machined or formed, according to the material selected. Because of the low stress on the device elements, little breakage or wear is expected over time and the device life should be long. The device elements are also simple and economical to produce, resulting in an inexpensive latching device being made available to the average household user.

From the foregoing description, it is believed that the preferred embodiment achieves the objects of the present invention. Various modifications and changes may be made to the invention latching device described above which are apparent to those skilled in the art. These alternatives and modifications are considered to be within the scope of the appended claims and are embraced thereby.

What is claimed is:

1. A latching device, comprising:

(a) a catch member for fastening to a movable cabinet door, said catch member having a cylindrical body with two opposing faces and including an axial, conical shaped orifice cut in a face at one end, said orifice including a deep annular groove in a wall; and (b) a probe member for fastening to a cabinet frame, said probe member being adapted to engage and disengage with said catch member, said probe member comprising:

an elongated housing shell having an open end and including an axial circular first opening in an opposite distal end;

a cap member adapted to fasten to said open end of said shell and closing said open end;

a tapered floating shaft attached loosely at one end to said cap member and disposed axially in said shell, with a distal end protruding through said first opening and positioned to engage said catch member; said shaft having a generally cone shaped head attached, axially to said distal end of said shaft; said head adapted to enter said orifice in said catch member and engage said groove, latching said catch member; and means disposed in said shell to separate said catch member from said probe member when said head of said shaft is disengaged from said groove;

said catch member being unlatched from said probe member by an external application of force to said cabinet door causing said shaft to become disengaged and free said catch member.

2. The latching device according to claim 1 wherein:

said means disposed in said shell to separate said catch member from said probe member, includes a helical spring and a tubular sleeve which are disposed linearly within said shell with an end of said spring pressing against an end of said sleeve, causing the distal end of said sleeve to project through said first opening in said shell; said sleeve being caused to move against the end of said spring and compress said spring when said probe member is moved to latch said catch member and said shaft engages said groove; said sleeve, when said shaft is disengaged, being pushed against the face of said catch member by said spring and thereby causing said catch member to separate from said probe member.

3. The latching device according to claim 1 wherein:

said catch member includes a mount for fastening said catch member to a cabinet door, said mount being attached to said body and including a plurality of through holes for screw fasteners.

4. The latching device according to claim 1 wherein:

said probe member includes a mount for fastening said probe member to a cabinet frame, said mount being attached to said shell and including a plurality of through holes for screw fasteners.

* * * * *